US005249803A

United States Patent [19]

Giffin

[11] Patent Number: 5,249,803

[45] Date of Patent: Oct. 5, 1993

[54] GOLF TRAINING CLUB

[76] Inventor: Bernard Giffin, 219 N. Collett St., Lima, Ohio 45805

[21] Appl. No.: 903,395

[22] Filed: Jun. 24, 1992

[51] Int. Cl.[5] ..... A63B 69/36

[52] U.S. Cl. ..... 273/193 A; 482/109

[58] Field of Search ..... 273/193 A, 26 B, 29 A, 273/193 R, 193 B, 194 R, 194 A, 194 B; 482/109

[56] References Cited

U.S. PATENT DOCUMENTS

| | | | |
|---|---|---|---|
| 1,930,342 | 10/1933 | Graham | 273/193 A |
| 3,133,735 | 5/1964 | Greenshields | 273/171 |
| 3,229,980 | 12/1966 | Silberman | 273/186 R |
| 3,317,211 | 5/1967 | Debski | 273/186 |
| 3,400,933 | 9/1968 | Heiser | 273/186 R |
| 3,458,203 | 7/1969 | Mangis | 273/194 |
| 3,680,870 | 8/1972 | Burnett et al. | 273/194 R |
| 3,716,239 | 2/1973 | Goudreau | 273/194 A |
| 3,722,890 | 3/1973 | Wieboldt | 273/186 A |
| 3,743,297 | 7/1973 | Dennis | 273/193 A |
| 3,758,117 | 9/1973 | Harrison | 273/194 B |
| 4,118,033 | 10/1978 | Miyamoto | 273/186 A |
| 4,168,068 | 9/1979 | Grover | 273/186 A |
| 4,213,614 | 7/1980 | Philippi | 273/194 B |
| 4,511,147 | 4/1985 | Olsen | 273/193 A |
| 4,529,204 | 7/1985 | Yamakawa | 273/193 R |
| 4,614,343 | 9/1986 | Radway | 273/186 A |
| 4,664,388 | 5/1987 | Huber | 273/186 A |
| 4,682,775 | 7/1987 | Wood | 273/186 A |
| 4,715,606 | 12/1987 | Varley | 273/194 B |
| 4,819,944 | 4/1989 | Doane | 273/193 A |
| 4,854,585 | 8/1989 | Koch | 273/193 B |
| 4,869,511 | 9/1989 | Spoonster | 273/194 B |
| 4,969,921 | 11/1990 | Silvera | 273/186 A |
| 4,982,963 | 1/1991 | Fazio | 273/186 A |
| 4,984,801 | 1/1991 | DeBack | 273/186 A |

*Primary Examiner*—George J. Marlo
*Attorney, Agent, or Firm*—Shlesinger, Arkwright & Garvey

[57] ABSTRACT

Golf training club includes a shaft having a grip end and a head end, a weight disposed at the head end, and a link nonintegrally attaching the weight to the head end of the shaft. Preferably, a single, rigid link attaches the weight to the shaft.

13 Claims, 3 Drawing Sheets

GOLF TRAINING CLUB

FIELD OF THE INVENTION

This invention is related to a golf training club.

BACKGROUND OF THE INVENTION

Amateur golfers spend endless hours in an attempt to perfect their golf swing, including professional lessons, video taping their swing for later playback, hitting buckets of balls at the practice range, and various other remedial measures. Among other golf swing characteristics, one of the most important features of the golf swing is the simple concept of a full, steady pendulum swing, both during the back swing and during the impact with the ball.

The back swing is the foundation of the swing in that, like a pendulum, the follow through and the down stroke are very much influenced by the trajectory arc at which the club is moving during the back swing. Said differently, the follow through is generally an "image" of the club head trajectory during the back swing.

Furthermore, the down swing must also be smooth, rather than choppy, and the follow through must be complete, rather than ending after hitting the ball. The purpose of the complete back swing is to transfer the momentum of the club head to the ball, and this momentum must be in the nature of a smooth pendulum type arc rather than chopping or punching at the ball.

Several devices have been developed as practice golf clubs which can be used for improving the golf swing.

For example, U.S. Pat. No. 3,229,980 to Silberman shows a Practice Golf Club having a standard hand grip attached to a short section of shaft, where a club head is tethered by a rope to the shaft section. Due to the flexibility of the club shaft, it may be difficult to have any control whatsoever over the club head leading to an inability to completely remedy the golf swing.

U.S. Pat. No. 3,722,890 to Wieboldt discloses a Golf Club Swing Training Device including a weighted body which is attached to a loop made of soft material such as nylon. The nylon loop is slipped over the shaft of a regular golf club, and the weight is designed to make an audible click when it hits the head of the golf club. The audible click is intended to tell the golfer when his or her back swing has been essentially completed. Although the weighted body is intended to apply an additional force during the swinging of the golf club, the golf club head is still rigidly attached to the shaft, inasmuch as the device is used with a standard golf club. Accordingly, less than the optimal amount of information on the golfer's swing is available to the golfer when using this device.

U.S. Pat. No. 4,118,033 to Miyamoto shows a weight attached to an end of a flexible shaft, where the flexible shaft is formed from fibers and steel wire. While the shaft is flexible, the weight is still somewhat rigidly attached to the shaft, and therefore it may be difficult to precisely determine the trouble areas in one's golf swing.

OBJECTS AND SUMMARY OF THE INVENTION

It is an object of the invention then to provide a golf club which can be used as a practice club as well as an exercise device for the golfer.

It is a further object of the invention to provide a practice club which can be used with a full swing.

It is yet another object of the invention to provide a practice golf club which can be used to detect errors in the golfer's swing, such as choppiness, timing problems, lack of follow through, and other problems.

It is a still further object of the invention to provide a golf training club for exercising the proper muscles utilized in a correct golf swing, and for developing a smooth and consistent back swing and follow through.

It is a further object of the invention to provide a golf training club having a shaft with a grip end and a head end, and means disposed at the head end for simulating the feel of a golf club as it is swung.

It is another object of the invention to provide a golf training club which has no head and which properly exercises the golfer's muscles and improves the full swing.

It is yet another object of the invention to provide a golf training club in which physical information is provided to the golfer if the back swing and follow through are not completed.

It is another object of the invention to provide a golf training club which provides physical information to the golfer as to the nature of the problems of his or her golf swing throughout the entire golf swing.

It is another object of the invention to provide a golf training club in which the overall length is substantially that of the length of a standard golf club.

These objects, and other objects and features of the invention which will become apparent as the entire specification is read, are accomplished by the invention according to which a golf training club includes a shaft having a grip end and a head end, a weight disposed at the head end, and a rigid link nonintegrally attaching the weight to the head end of the shaft.

These objects and advantages of the invention have also been accomplished by the golf training club according to the invention in which a headless golf training club is provided that includes a shaft having a first end and a second end spaced from the first end, a weight disposed at the second end, and a connecting means for nonintegrally attaching the weight to the second end and for causing the weight to shift relative to said second end when the shaft undergoes changes in direction of motion; whereby, in use, the weight simulates the physical attributes of a golf club head.

BRIEF DESCRIPTION OF THE DRAWINGS

FIG. 7 shows the position of the golf training club when the golfer is half-way through the follow through; and FIG. 8 shows the position of the golfer when the golfer has completed his follow through.

DETAILED DESCRIPTION OF THE INVENTION

Figure 1:
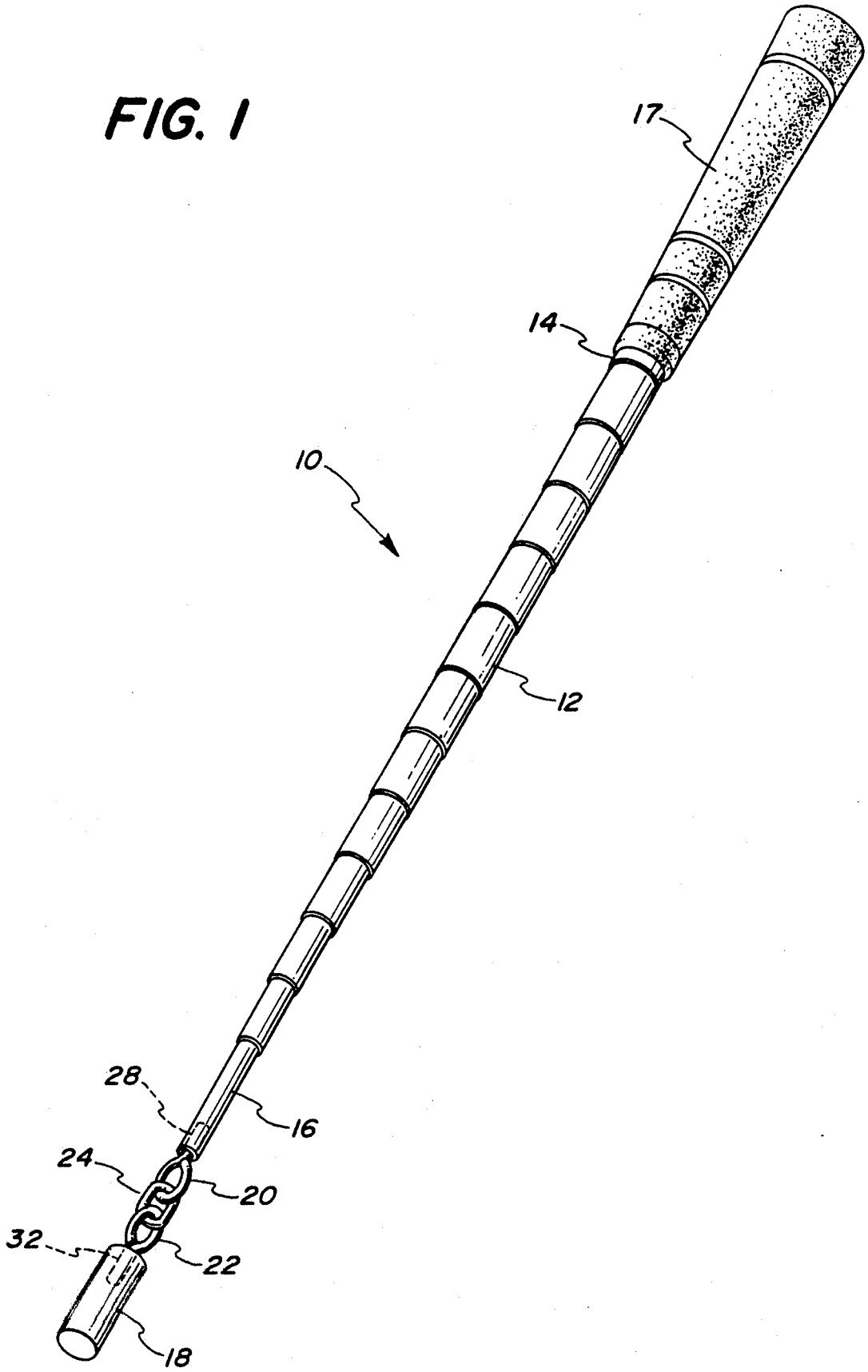
FIG. 1 is a perspective view of the golf training club.

FIG. 1 shows a preferred embodiment of a golf training club 10 according to the invention. Golf training club 10 includes a shaft 12 having a grip end 14 and a head end 16. A grip 17 is attached to grip end 14 and a weight member 18 is disposed at head end 16. Weight member 18 is indirectly, nonrigidly, and nonintegrally attached to head end 16 of golf training club 10 by means of a shaft connection member 20 and a weight connection member 22.

A link member 24 is disposed between and attached to shaft connection member 20 and weight connection member 22. It should be noted that weight member 18 may be permanently or removably attached to shaft 12. Weight connection member 22 and shaft connection member 20 are each fixedly, rigidly attached to weight 18 and shaft 16, respectively. It is important that weight member 18 be nonrigidly connected to shaft 12, while at the same time connected in such a manner that when golf training club 10 is in use forces developed at and by weight member 18 are transmitted through link member 24 to shaft 12. This will be explained in greater detail below under the OPERATION of the invention.

In a preferred embodiment of the golf training club according to the invention, shaft connection member 20 and weight connection member 22 are eyebolts or screw eyes. Shaft connection member or eyebolt 20 has a shank section 28 extending into a hollow bore at head end 16. Shank 28 of eyebolt 20 is epoxied or otherwise fixedly held in place relative to shaft 12 in a manner similar to which golf heads in general are epoxied to shafts, as will be readily apparent to a person having ordinary skill in the art.

Similarly, weight connection member 22 may be an eyebolt having a shank 32 extending into a hole formed in weight member 18 and may be likewise epoxied or fixedly held in place relative to weight member 18 as will be readily understood.

Figure 2:
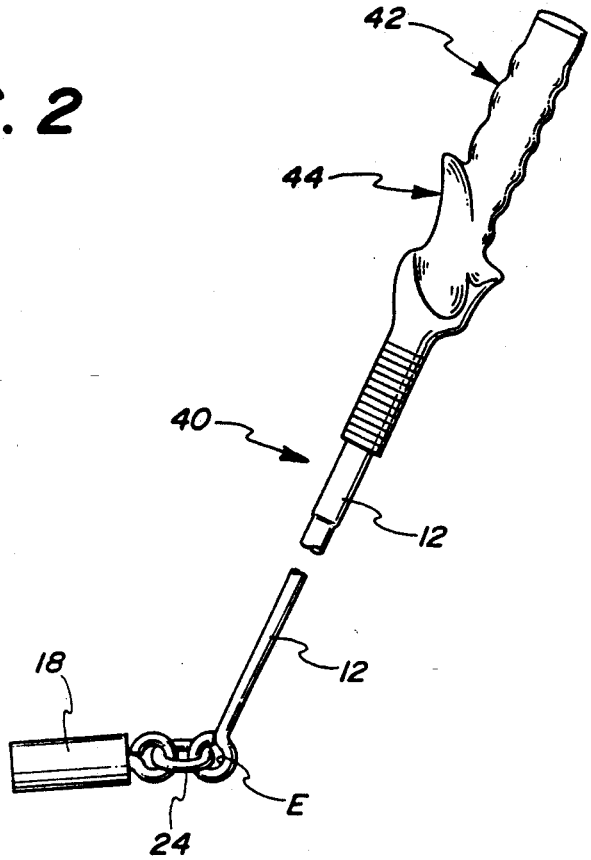
FIG. 2 is a second embodiment of the golf training club, having an alternate training grip.

Turning to FIG. 2, a further preferred embodiment of a golf training club 40 according to the invention is shown. Golf training club 40 has a grip 42 which includes sculptured protrusions generally indicated at 44 that guide a golfer in the correct gripping of golf training club 40. Grip 42 is known as a training grip and may be, for example, a LAMKIN training grip. Such a grip is molded to assist the golfer in correctly positioning his or her hands for properly gripping the golf club.

In this preferred embodiment, it is important that the proper relationship between shaft connection member 20 and grip 42 be established before each is fixedly epoxied in place relative to shaft 12. Accordingly, in this embodiment it has been found advantageous to permanently affix eyebolt 20 to shaft 12 before fixing grip 42 in place. After eyebolt 20 has been attached, grip 42 is slipped over shaft 12. The golfer or assembler of golf training club 40 then holds configured grip 42 properly in his or her two hands. The assembler stands, holding golf training club 40 in a proper stance for addressing a golf ball (not shown), and sights forwardly and downwardly paying particular attention to the orientation of eyebolt 20.

The orientation of eyebolt 20 should be selected such that a plane defined by eye or eyelet E of eyebolt 20 extends substantially perpendicularly to a plane defined by the longitudinal axis of shaft 12 and the longitudinal axis of a golfer standing and holding the club addressing the golf ball.

After the correct orientation of eyebolt 20 is established, then grip 42 is taped in place.

Alternatively, grip 42 can be fixedly attached first, then shaft connection member 20 is secured in the proper orientation described above. It will be appreciated that epoxy is merely an example of securing means; alternatives such as self-locking nuts can be used to secure connection member 20 to shaft 12 and connection member 22 to weight 18.

Although other orientations of eyebolt 20 relative to grip 42 are satisfactory, the orientation described immediately above is preferred. An orientation of eyebolt 20 to be avoided is the one in which the plane defined by the longitudinal axis of shaft 12 and the longitudinal axis of the golfer while standing in the correct golf stance is substantially coplanar with the plane defined by eyebolt 20. In other words, the plane defined by eyebolt 20 should not extend vertically when the golf training club according to the invention is held in proper position as the golfer addresses the golf ball at the beginning of his or her stroke.

Figure 3:
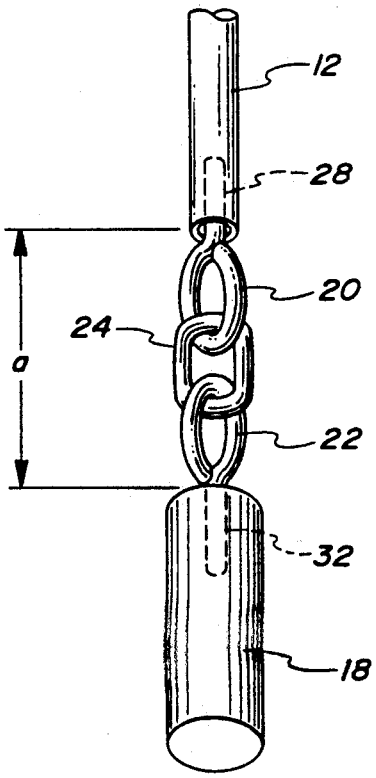
FIG. 3 shows a portion of the golf training club of FIG. 1, on an enlarged scale.
Figure 4:
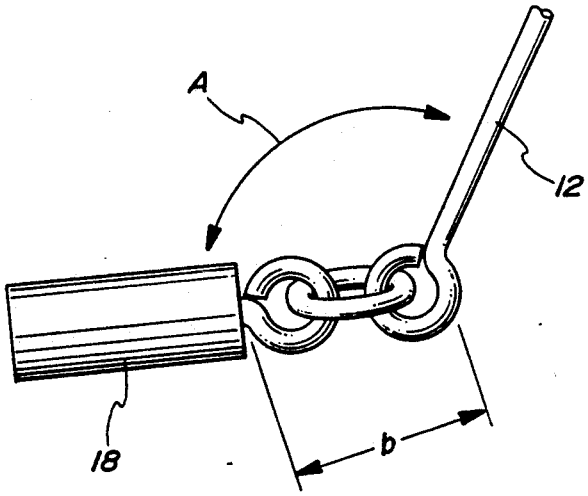
FIG. 4 is a portion of the golf training club of FIG. 2, on an enlarged scale.

FIGS. 3 and 4 show a preferred embodiment of the weight end of the golf training clubs of FIGS. 1 and 2, on an enlarged scale. Through testing it has been found that weight 18 has a weight preferably in the range of 9 to 11.5 ounces, 11.5 ounces being a preferred weight when the following preferred weights and lengths are used. The overall length of the golf training club according to the invention is about 42 inches, and having a total weight of about 20 ounces. The weight of shaft 12 and the grip is preferably about 6 ounces, the weight of link 24 and connection members 20 and 22 being about 2.5 ounces preferably.

Weight 18 is not limited to being cylindrical in shape, and may have other configurations such as a sphere. A cylindrical configuration has been used successfully in which weight member 18 was a cylindrical rod of about 2.5 inches in length and having a diameter of about 1 inch.

Conveniently, a threaded hole is formed in one end of weight member 18 into which a threaded end of an eyebolt serving as weight connection member 22 is threaded, the mating threads providing a larger surface area on which epoxy has been successfully used for fixedly attaching weight member 18 and eyebolt 22. Connection members 20 and 2 have been successfully used in which each member was an eyebolt made of an elongated rod forming the eyelet E and the respective shank, the diameter of the rod being about 3/16 inch, the outside diameter of eyelet E being about ⅝" to about 1", the inner diameter having a range of about ½" to ⅝".

Link 24 has been successfully constructed from an elliptical, steel link made of a curved elongated rod having a rod diameter of about 5/32", the major length being about 1", the minor length (i.e., the width) being about ⅝", thereby defining an inner major length of about 13/16" and an inner minor length of about 5/16". During experimentation with various numbers of links 24, it was found that directly connecting eyebolts 20 and 22 was unsatisfactory. Providing multiple links in place of link 24 was likewise found unsatisfactory, the use of more than one link 24 giving little useful physical information to the golfer, apparently owing to excess slop. A single link 24 provided the best results.

Owing to the physical structure of rigid link 24 and its relation to shaft connection member 20 and weight connection member 22, a shortening of the distance a (FIG. 4) between weight 18 and head end 16 resulting in shortened distance b (FIG. 5) results. This shortening of the distance between weight 18 and shaft 12 and, hence, the grip and ultimately the golfer apparently is an important aspect of why the golf training club of the present invention works so well.

In one of the preferred embodiments having the preferred dimensions described above, length a is about 2.5" when weight 18 is fully spaced apart from shaft 12 as during the greater portion of a proper golf swing (see FIGS. 1, 3, 5 and 7). FIG. 4 shows the shortened distance b as weight 18 is shifting relative to shaft 12 near the end of the stroke; i.e., near the end of the back swing or follow through. The distance b shown in FIG. 4 will be about 2.25" when the angle of an arc A between the centerlines of weight 18 and shaft 12 is about 120°. This is an example of the shortening of the distance between weight 18 and shaft 12. As the angle of arc A decreases, the distance between weight 18 and shaft 12 will likewise decrease. This shifting of weight 18 and the effective shortening of a distance between weight 18 and head end 16 of shaft 12 is believed to contribute the desired "feel" to the golf training club according to the invention.

When the golf training club is swung, the angle defined by arc A will be at least about 180°. During a standard swing, link 24 will move relative to shaft connection member 20, while weight connection member 22 and, hence, weight 18, will generally remain substantially aligned with link 24.

The provision of discrete linking elements; i.e., shaft connection member 20, weight connection member 22, and link 24 works better than the known cable connections between a weight member and a golf club shaft because any unevenness, jerkiness, or other irregularities in the golfer's swing are more easily detected by the golfer.

In practice, when constructing golf training club 10 having grip 17, which is substantially symmetrical about its longitudinal axis, grip 17 is simply glued or attached by two sided tape onto shaft 12 because the golfer will be instructed to orient shaft connection member 20 relative to the golfer's stance when using the club. That is, the orientation of eyelet E relative to the golfer will be as described in the discussion of the affixing of the configured grip 42 of the embodiment of the golf training club of FIG. 2 above.

The material of the shaft, links and weight is preferably steel. A shaft of other materials may be used, such as wood and appropriate synthetic materials which may likewise be used for the links and eyelets, and grip. It is important that the link and the connection members be sufficiently rigid so as to impart irregularities in the swing from the weight to the shaft in order to inform the golfer as to irregularities in his or her swing. The link is preferably elliptical, and the shaft connection member and the weight connection member are preferably made of semi-circular rods, such as eyebolts or screw eyes. The preferred length of the golf training club is that of a standard two wood; good results have also been achieved when the length of the golf training club is that of a five wood shaft.

OPERATION

FIGS. 5-8 show the manner in which a golfer uses golf training club 10 according to the invention. The golfer assumes a standard stance, and performs a complete stroke as if hitting a golf ball with a regular golf club. Preferably, the golfer holds club 10 in the manner described above for orienting grip 42 relative to eyebolt 20. When club 40 is used, the proper orientation of configured grip 42 relative to eyebolt 20 ensures the preferred manner of holding the inventive club.

Figure 5:
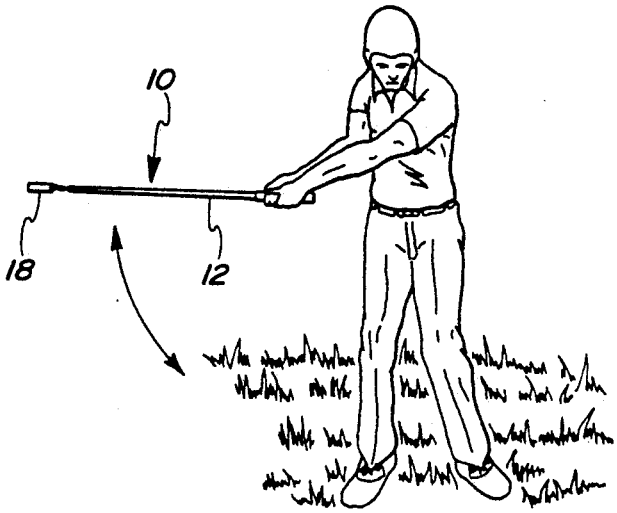
FIG. 5 shows an action view of the golf training club where the practice training club is half-way through the golfer's back swing.

FIG. 5 shows the golfer with golf training club 10 according to the invention midway of the back swing. At this point in the back swing, weight member 18 is substantially lined up with shaft member 12 owing to the centrifugal force exerted on weight member 18. It should be noted that golf shaft 12 is relatively rigid, thereby allowing a full speed and full arc practice golf swing.

Figure 6:
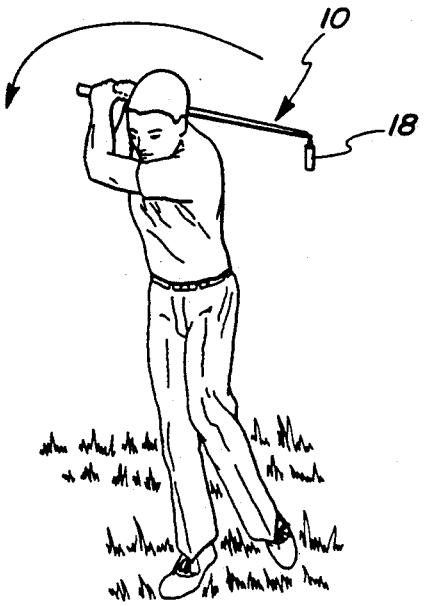
FIG. 6 shows the position of the golf training club when the golf training club is at the top of the back swing.

FIG. 6 illustrates when the golfer reaches the top of his or her back swing, golf training club 10 having come to a momentary stationary position where shaft 12 is temporarily oriented substantially parallel to the ground, whereby weight member 18 continues to pivot, owing to its momentum, relative to shaft 12 to the position shown in FIG. 6. This movement of weight 18 can be felt by the golfer.

It should be understood that if the golfer has a choppy back swing or other sudden acceleration or deceleration in his or her swing, the golfer will detect such sudden undesirable movements by way of pivoting movement of weight member 18 with respect to shaft 12. Not only does weight member 18 give an important physical indication of irregularities in the golfer's swing that can be felt by the golfer through his or her hands, but the manner in which weight 18 is attached to shaft 12 by link 24 causes weight 18 to come down on the golfer's back swing, thereby effectively causing the golfer to complete the back swing. If the back swing is not completed, weight 18 will jerk and give a physical indication to the golfer that back swing was not properly finished. In other words, weight 18 will "try" to complete the back swing for the golfer.

Figure 7:
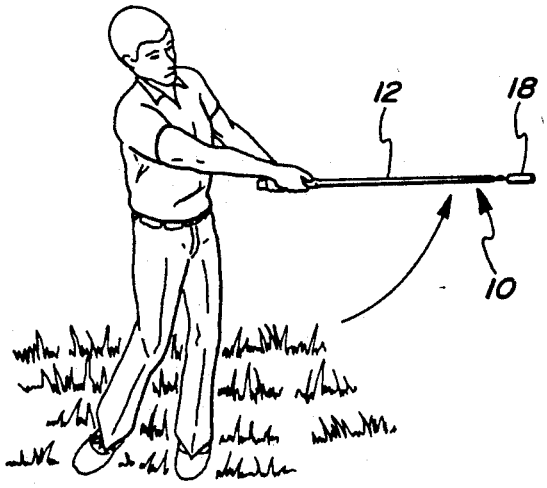
Figure 8:
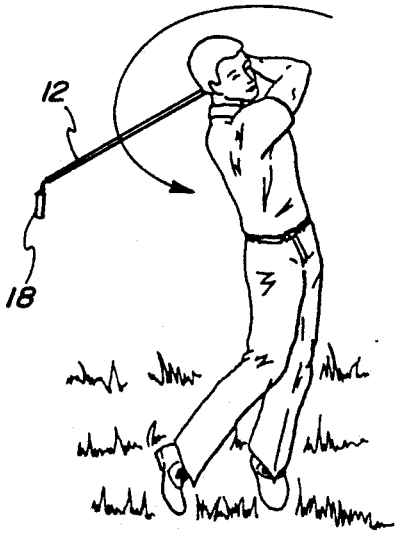

FIG. 6 shows the completion of the back swing, and, of course, the beginning of the follow through of the golfer's swing. Accordingly, the entire follow through is shown in the sequence of FIGS. 6-8. The follow through is as important as the back swing. FIG. 6 shows the golfer's swing at the top of his or her back swing, the golfer beginning to reverse the direction of the club towards the imaginary golf ball.

FIG. 7 shows the position of the golf training club 10 after the golf ball impact position and about half way through the golfer's follow through. It should be noted that weight member 18 is again in a substantially in-line position with shaft member 12.

FIG. 8 shows the manner in which the follow through should have been continued by the golfer, golf shaft 12 being again substantially parallel to the ground as at the end of the golfer's back swing (FIG. 6). At the end of the follow through, weight member 18 has again pivoted somewhat owing to the deceleration of golf shaft 12, the momentum of weight member 18 consequently causing weight member 18 to rotate relative to connection member 20 and shaft 12.

Thus, the golf training club according to the invention will give direct, instant feedback to the golfer as to any lack of smoothness in the stroke. Not only are irregularities detected and "reported" to the golfer by means of the shifting of weight 18, but an incomplete follow through is likewise signalled to the golfer in a manner similar to the signalling of an incomplete back swing (FIG. 6). If the golfer does not have a complete follow through, such as when the golfer is in the position shown in FIG. 7, weight member 18 will begin to pivot at the end of golf training club 10, rather than being substantially in line with shaft 12 as shown in FIG. 7.

It should also be appreciated that if the golfer substantially cuts across the imaginary ball, as opposed to executing a smooth arcuate swing this will be detected by the movement of the weight from side to side. As will be readily appreciated, the force of this sideways movement of weight 18 will be transmitted through weight connection member 22, link 24, shaft connection member 20, shaft 12, grip 17, and ultimately to the golfer's hands and arms.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. A golf training club comprising:
a) a shaft having a grip end and a head end;
b) a weight disposed at said head end;
c) a rigid link nonintegrally attaching said weight to said head end of said shaft; and
d) said rigid link includes only one link.

2. A golf training club as defined in claim 1, wherein:
a) a grip is disposed on said grip end of said shaft.

3. A golf training club as defined in claim 1, wherein:
a) a shaft connection member is disposed at said head end of said shaft;
b) a weight connection member is disposed on said weight; and
c) said rigid link indirectly attaches said weight connection member to said shaft connection member.

4. A golf training club as defined in claim 3, wherein:
a) each one of said shaft connection member and said weight connection member includes an elongated, curved semi-circular rod; and
b) said rigid link includes a substantially elliptical elongated rod.

5. A golf training club as defined in claim 1, wherein:
a) an outstretched length of said weight, rigid link and shaft is about 42 inches.

6. A golf training club comprising:
a) a shaft having a grip end and a head end;
b) a weight disposed at said head end;
c) a connecting means for indirectly attaching said weight to said head end and for causing said weight to shift relative to said head end when said shaft undergoes changes in direction of motion; and
d) said connecting means includes a single, rigid link.

7. A golf training club as defined in claim 6, wherein:
a) a grip is disposed on said grip end of said shaft.

8. A golf training club as defined in claim 7, wherein:
a) a shaft connection member is fixedly attached to said head end of said shaft;
b) a weight connection member is fixedly attached to said weight; and
c) said rigid link nonintegrally attaches said weight connection member to said shaft connection member.

9. A golf training club as defined in claim 8, wherein:
a) each one of said shaft connection member and said weight connection member includes an elongated, curved semi-circular rod; and
b) said link includes a substantially elliptical elongated rod.

10. A headless golf training club, comprising:
a) a shaft having a first, grip end and a second end spaced from said first end;
b) a weight disposed at said second end;
c) a shaft connection member disposed at said second end of said shaft;
d) a weight connection member disposed on said weight; and
e) a single link indirectly pivotably attaching said weight connection member to said shaft connection member.

11. A headless golf training club as defined in claim 10, wherein:
a) a grip is disposed on said grip end of said shaft.

12. A headless golf training club as defined in claim 10, wherein:
a) each one of said shaft connection member and said weight connection member includes an elongated, curved semi-circular rod; and
b) said link includes a substantially elliptical elongated rod.

13. A golf training club as defined in claim 10, wherein:
a) said link has a major length of about 1 inch, a width of about $\frac{5}{8}$ inch, a diameter of said rod is about 5/32 inch, the inner major length of an opening defined by said elliptical element is about 11/16 inch, and the internal width defined by said elliptical element is about 5/16 inch.

* * * * *